US009924776B2

(12) United States Patent
Schlatter et al.

(10) Patent No.: US 9,924,776 B2
(45) Date of Patent: Mar. 27, 2018

(54) CONTAINER FOR A COSMETIC PRODUCT

(71) Applicant: ORALABS, INC., Parker, CO (US)

(72) Inventors: Gary Schlatter, Englewood, CO (US); Chris Turner, Parker, CO (US)

( * ) Notice: Subject to any disclaimer, the term of this patent is extended or adjusted under 35 U.S.C. 154(b) by 0 days.

(21) Appl. No.: 15/213,102

(22) Filed: Jul. 18, 2016

(65) Prior Publication Data

US 2017/0013936 A1 Jan. 19, 2017

Related U.S. Application Data

(60) Provisional application No. 62/193,867, filed on Jul. 17, 2015.

(51) Int. Cl.
*A45D 40/00* (2006.01)
*A45D 33/02* (2006.01)

(52) U.S. Cl.
CPC ..... *A45D 33/02* (2013.01); *A45D 40/00* (2013.01); *A45D 2040/0062* (2013.01)

(58) Field of Classification Search
USPC ..... 401/88, 98
See application file for complete search history.

(56) References Cited

U.S. PATENT DOCUMENTS 2,318,152 A * 5/1943 Gelardin ..... A45D 40/06 401/78
4,235,557 A 11/1980 Hayes
4,552,161 A 11/1985 Hill et al.
4,579,134 A * 4/1986 Moore ..... A45D 40/04 132/320
4,728,210 A 3/1988 Barish et al.
4,792,251 A * 12/1988 Ryder ..... A45D 40/06 401/74

(Continued)

FOREIGN PATENT DOCUMENTS

EP 1068817 1/2001
FR 2766339 1/1999

(Continued)

*Primary Examiner* — Jennifer C Chiang
*Assistant Examiner* — Bradley Oliver
(74) *Attorney, Agent, or Firm* — Welsh Flaxman & Gitler LLC

(57) ABSTRACT

A container for dispensing a cosmetic product includes a first container member and a second container member shaped and dimensioned for coupling together so as to define a cavity therebetween for storing a cosmetic product. The first container member includes an exterior surface and an interior surface. The first container member further includes an apex having an aperture formed therein and an open end opposite the apex, the open end defining a circumferential free edge that is opposite the aperture. A plurality of ribs radially extend from the interior surface of the first container member toward a central axis running through a center of the aperture such that the plurality of ribs define an elongated passageway extending on the central axis. Each of the plurality of ribs includes an edge attached to the interior surface, a free edge and a supporting edge shaped and dimensioned for supporting cosmetic product above the supporting edge after cosmetic product is gravity fed through the passageway. A plug covers the aperture after the cosmetic product has been fed into the cavity.

14 Claims, 9 Drawing Sheets

(56) References Cited

U.S. PATENT DOCUMENTS

| | | | | |
|---|---|---|---|---|
| 5,092,700 | A | 3/1992 | Susini et al. | |
| 5,109,879 | A * | 5/1992 | Seidler | A45D 40/0087 132/320 |
| 5,609,430 | A * | 3/1997 | Mazzola | A45D 40/04 401/68 |
| 5,738,123 | A | 4/1998 | Szekely | |
| 5,799,667 | A | 9/1998 | Szekely | |
| 5,813,784 | A | 9/1998 | Durliat | |
| 5,884,637 | A * | 3/1999 | Joulia | A45D 40/00 132/318 |
| 6,029,842 | A | 2/2000 | Sheffler et al. | |
| 7,025,520 | B2 * | 4/2006 | Petit | B65D 83/0055 206/504 |
| 7,651,292 | B2 * | 1/2010 | Tavares da Silva | A45D 34/041 401/214 |
| 7,699,062 | B2 | 4/2010 | Sasaki | |
| 7,802,937 | B1 | 9/2010 | Szekely | |
| 8,444,337 | B2 | 5/2013 | Teller | |
| 8,888,391 | B2 | 11/2014 | Teller et al. | |
| 2006/0201838 | A1 * | 9/2006 | Sasaki | A45D 40/10 206/385 |
| 2009/0022541 | A1 | 1/2009 | De Laforcade | |
| 2011/0135377 | A1 * | 6/2011 | Teller | A45D 40/00 401/88 |
| 2015/0096919 | A1 | 4/2015 | Thompson | |
| 2015/0251052 | A1 * | 9/2015 | Zaker | A45D 40/16 482/49 |
| 2017/0013935 | A1 * | 1/2017 | Schlatter | A45D 40/00 |

FOREIGN PATENT DOCUMENTS

| | | |
|---|---|---|
| GB | 2162822 | 2/1986 |
| JP | 2004321410 | 11/2004 |

* cited by examiner

CONTAINER FOR A COSMETIC PRODUCT

CROSS REFERENCE TO RELATED APPLICATION

This application claims the benefit of U.S. Provisional Patent Application Ser. No. 62/193,867, entitled "CONTAINER FOR A COSMETIC PRODUCT," filed Jul. 17, 2015.

BACKGROUND OF THE INVENTION

Field of the Invention

The present invention generally relates to container for a cosmetic product. In particular, the invention relates to a container for a lip balm product.

SUMMARY OF THE INVENTION

It is, therefore, an object of the present invention to provide a container for dispensing a cosmetic product. The container includes a first container member and a second container member shaped and dimensioned for coupling together so as to define a cavity therebetween for storing a cosmetic product. The first container member includes an exterior surface and an interior surface, as well as an apex having an aperture formed therein and an open end opposite the apex. The open end includes a circumferential free edge that is opposite the aperture wherein the interior surface extends between the aperture and the open end. A plurality of ribs radially extend inwardly from the interior surface of the first container member toward a central axis running through a center of the aperture such that the plurality of ribs define an elongated passageway extending on the central axis. Each of the plurality of ribs includes an edge attached to the interior surface, a free edge and a supporting edge shaped and dimensioned for supporting cosmetic product above the supporting edge after cosmetic product is gravity fed through the passageway. A plug covers the aperture after the cosmetic product has been fed into the cavity.

It is also an object of the present invention to provide a container including a cosmetic product stored within the cavity.

It is another object of the present invention to provide a container wherein the second container member includes a closed end and an open end opposite the closed end, wherein the open end includes a circumferential free edge.

It is a further object of the present invention to provide a container wherein the circumferential free edge of the second container member includes threads which mate with threads on the circumferential free edge of the first container member.

It is also an object of the present invention to provide a container wherein the second container member includes a molding cup frictionally retained between the closed end and the open end thereof.

It is another object of the present invention to provide a container wherein the supporting edge is flat.

It is a further object of the present invention to provide a container wherein the supporting edge has a curved profile.

It is also an object of the present invention to provide a container wherein each of the plurality of ribs includes a slot which defines an annular ring between the supporting edges of the plurality of ribs and the interior surface.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

Figure 1:
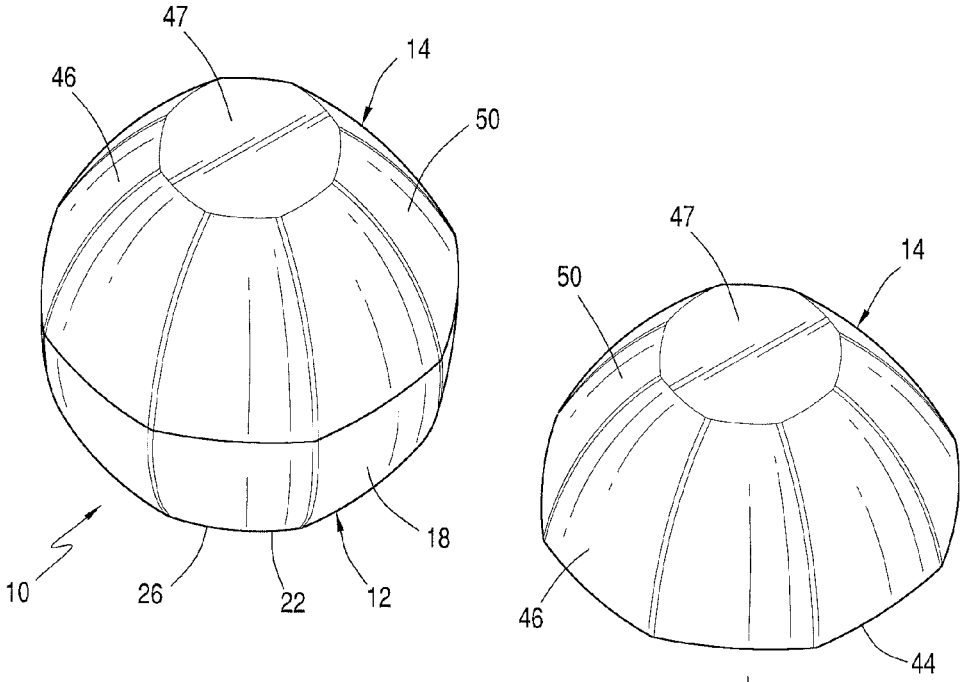
FIG. 1 is a perspective view of a closed container in accordance with the present invention.
Figure 2:
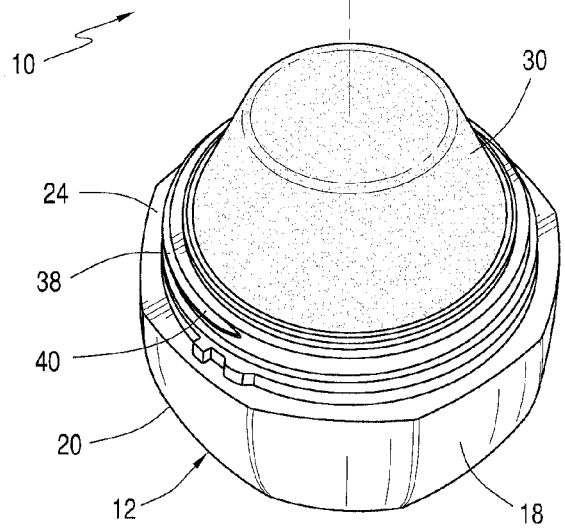
FIG. 2 is a perspective view an open container in accordance with the present invention.
Figure 3:
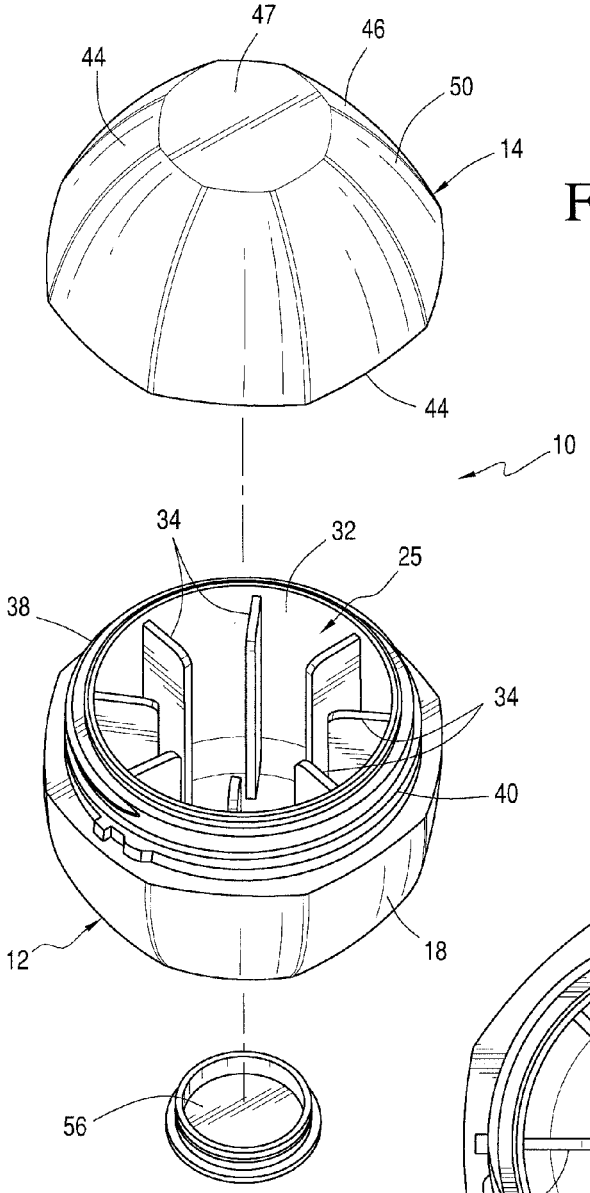
FIG. 3 is an exploded view of the present container in accordance with a first embodiment.
Figure 4:
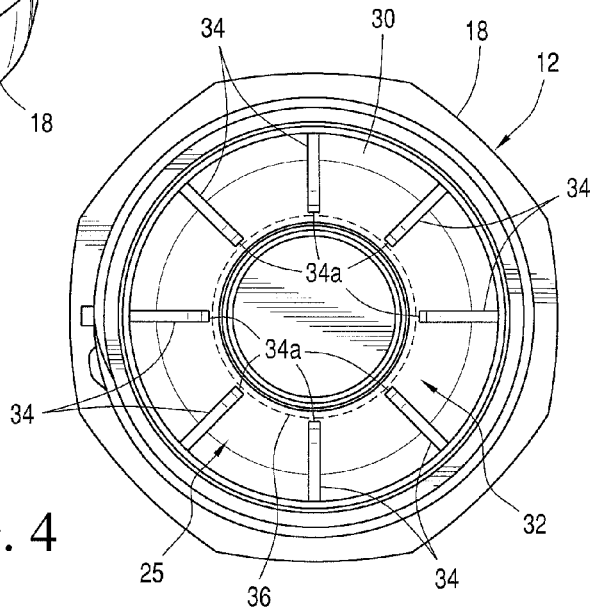
FIG. 4 is a top plan view of the first container member shown in FIG. 3.
Figure 5:
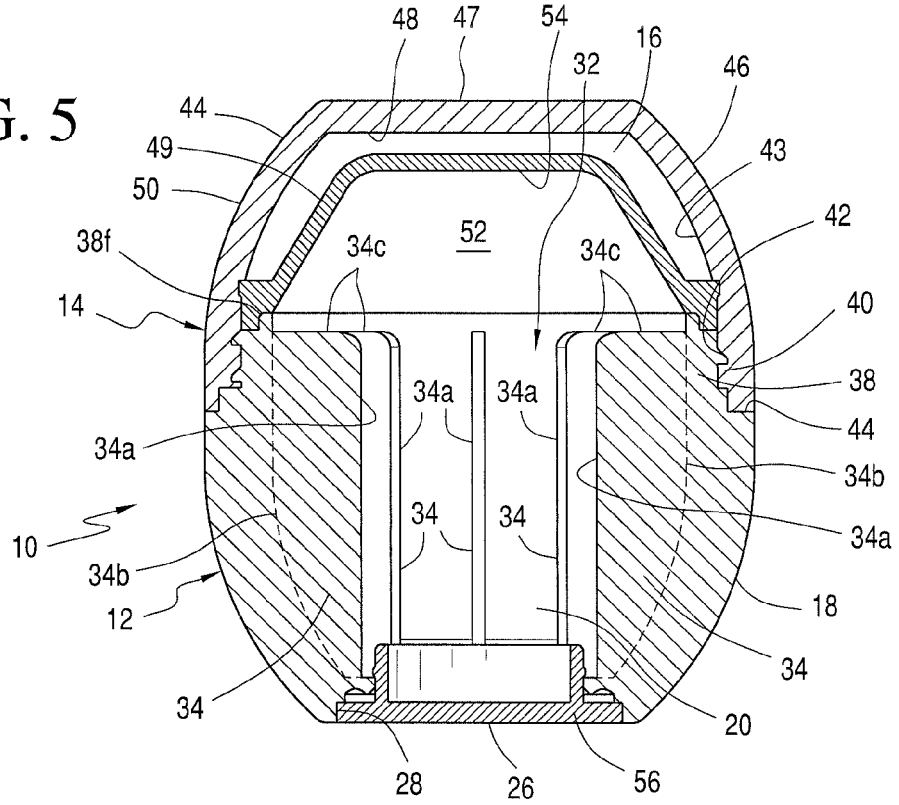
FIGS. 5 and 6 are cross-sectional view showing the container shown in FIG. 3 unfilled and filled with cosmetic product, respectively.

The detailed embodiments of the present invention are disclosed herein. It should be understood, however, that the disclosed embodiments are merely exemplary of the invention, which may be embodied in various forms. Therefore, the details disclosed herein are not to be interpreted as limiting, but merely as a basis for teaching one skilled in the art how to make and/or use the invention.

Referring to FIGS. 1 to 10, the container 10 includes a first container member 12 and a second container member 14 shaped and dimensioned for selectively coupling together so as to define a cavity 16 therebetween. Lip balm, or other cosmetic product, is stored within the cavity 16 for ready access by a user. It is appreciated the term "cosmetic product(s)" as used in the present disclosure is intended to encompass a broad range of products including, but not limited to, personal care or medicated products intended for application to the lips or body of an individual (for example, sunscreens, lip colors, moisturizers, etc.), and may take the form of balms, salves, creams, butters, gel products as well as other similar compositions. The exterior surface of the container 10 is of a substantially rounded configuration with a series of equally spaced longitudinal edges extending between the top and bottom thereof.

The first container member 12 as shown is of a "substantially" semi-spherical configuration, but could be formed in a variety of shapes. It is considered "substantially" semi-spherical as it includes rounded side walls with equally spaced longitudinal edges and a flat apex 26 which resembles an octagon when viewed in cross-section. The first container member 12 includes an exterior surface 18 and a concave interior surface 20. The first container member 12 is preferably formed by plastic injection molding, although it is appreciated other manufacturing techniques may be employed in the manufacture of the first container member 12. With such a structure in mind, the first container member 12 is dome shaped and has a circumferential free edge 24 along the open end (or open side) 25 of the first container member 12. As will be appreciated based upon the following description, the first container member 12 is provided with an aperture 28 at the apex 26. The aperture is shaped and dimensioned to allow for the insertion of liquefied cosmetic product 30 during the filling process. The aperture 28 is ultimately covered with a cover member 56 to complete the continuous surface defined by the first container member 12, after filling is completed as described below in greater detail.

The circumferential free edge 24 of the first container member 12 includes an upwardly extending ridge 38 (that is, extending away from the concave interior surface 20) having external threading 40 formed thereupon. The free end **38*f* of the upwardly extending ridge 38 defines the upper extent of the first container member 12 along the open end 25 The external threading 40 is shaped and dimensioned for engagement with internal threading 42 formed along an interior surface 43 of the second container member 14 adjacent the circumferential free edge 44 of the second container member 14. While external threading is shown on the first container member 12 and internal threading is shown the second container member 14**, it is contemplated that the threading could be reversed.

The interior surface 20 of the first container member 12 defines a first cavity 32 in which is formed a plurality of inwardly extending ribs 34. The ribs 34, in conjunction with the aperture 28, should be thought of as defining an elongated passageway 36 extending on the central axis 35 of the semi-spherical body defined by the first container member 12 (see FIGS. 4 and 6). The elongated passageway 36 provides a channel for the injection of cosmetic product during the filling of the container 10 in a manner explained below in greater detail.

With this in mind, each of the ribs 34 radially extends from the interior surface 20 of the first container member 12 toward the central axis 35 of the first cavity 32 (that is, the axis normal to the apex 26 of the first container member 12). Each of the ribs 34 includes a free edge **34*a*, an attached edge 34*b*, and a supporting edge 34*c***.

The attached edge **34*b* of each rib 34 is integrally molded to extend from the interior surface 20 of the first container member 12. By integrally molding the ribs 34 with the first container member 12 the present invention eliminates the need for a separate support grid for the cosmetic product and provides a cost savings. The free edge 34*a* of each rib 34 is in substantially parallel alignment with the elongated passageway 36, while the supporting edge 34*c* of each rib 34 is oriented transverse to the free edge 34*a* and provides a surface upon which the cosmetic product may reside in a manner as will be discussed below in greater detail. As such, the free edges 34*a* may be thought of as extending substantially parallel to the central axis 35 while the supporting edges 34*b* extend substantially perpendicular to the central axis 35**.

As mentioned above, each of the ribs 34 extends radially inwardly from the interior surface 20 toward the central axis 35. However, the ribs 34 end before they reach the central axis 35 of the first cavity 32. The free edges **34*a* are, therefore, radially spaced from the central axis 35 and positioned in alignment with the elongated passageway 36. Each of the ribs 34 ends approximately in alignment with an extension of the aperture 28 along the central axis 35. As such, the free edges 34*a* of the ribs 34, in conjunction with the aperture 28, define the elongated passageway 36**.

Figure 11:
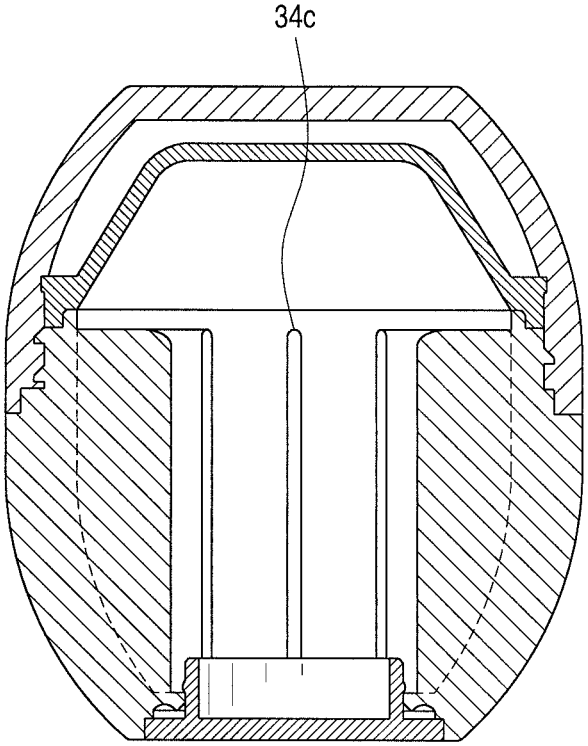
FIG. 11 is a cross-sectional view of the container showing an alternate construction for the rib of the first container member.
Figure 12:
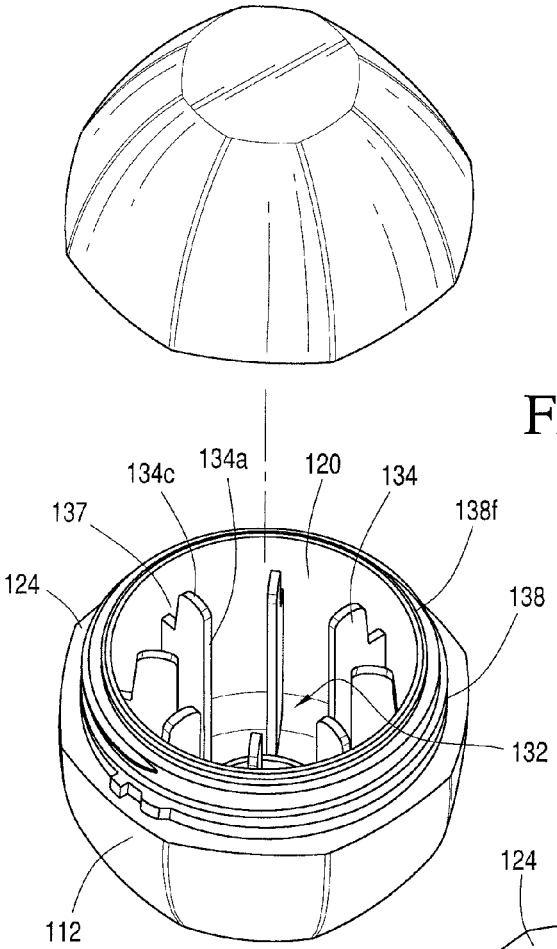
FIG. 12 is a perspective view of the open container in accordance with an alternate embodiment of the present invention.
Figure 13:
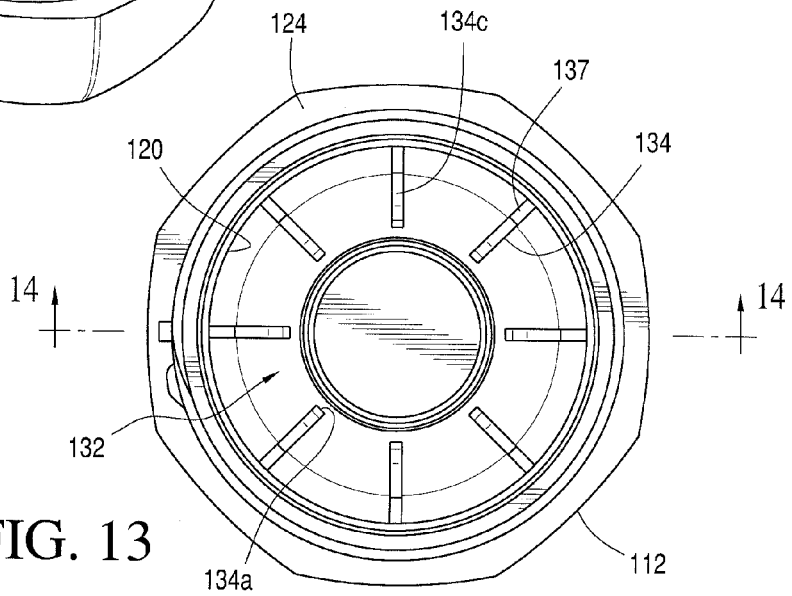
FIG. 13 is a top plan view of the first container member in accordance with the embodiment shown in FIG. 12.

The ribs 34 are of such a height that they extend along the interior wall 20 to a height slightly below the plane in which the free end **38*f* of the upwardly extending ridge 38 of the circumferential free edge 24 of the first container member 12 lies. Consequentially, the supporting edges 34*c* of the ribs 34 lie in a plane slightly below the plane in which the free end 38*f* of the upwardly extending ridge 38 of the circumferential free edge 24 of the first container member 12 lies. By recessing the supporting edges 34*c* slightly below the free end 38*f* of the upwardly extending ridge 38, a retaining edge is defined that assists in maintaining the cosmetic product in position upon the ribs 34. Referring to FIGS. 1-10 it is shown that the supporting edges 34*c* are substantially flat, however, and with reference to FIG. 11 it is contemplated the supporting edges 34*c*** may be made with a curved profile so as to increase the surface area provided by the supporting edges.

The second container member 14 as shown is of a "substantially" semi-spherical configuration, but could be formed in a variety of shapes. The second container member 14 includes a convex exterior surface 46 and a concave interior surface 48. It is considered "substantially" rounded as it includes a rounded side walls with longitudinal edges and a flat apex 47. With such a semi-spherical structure in mind, the second container member 14 includes a domed shape having a circumferential free edge 44 along the open end (or open side) 45 thereof. Adjacent the circumferential free edge 44, and along the concave interior surface 48 of the second container member 14, internal threading 42 is formed. The internal threading 42 is shaped and dimensioned for engagement with the external threading 40 formed along the circumferential free edge 24 of the first container member 12. In this way, the first container member 12 and the second container member 14 may be selectively attached and detached so as to expose the contents of the cavity 16. As will be appreciated based upon the following disclosure, consistent molding of the cosmetic product 30 within the container 10, in particular, the second container member 14, is achieved by securing a molding cup 49 within the second container member 14 so as to cover the concave interior surface 48 and provide a molding surface.

Figure 6:
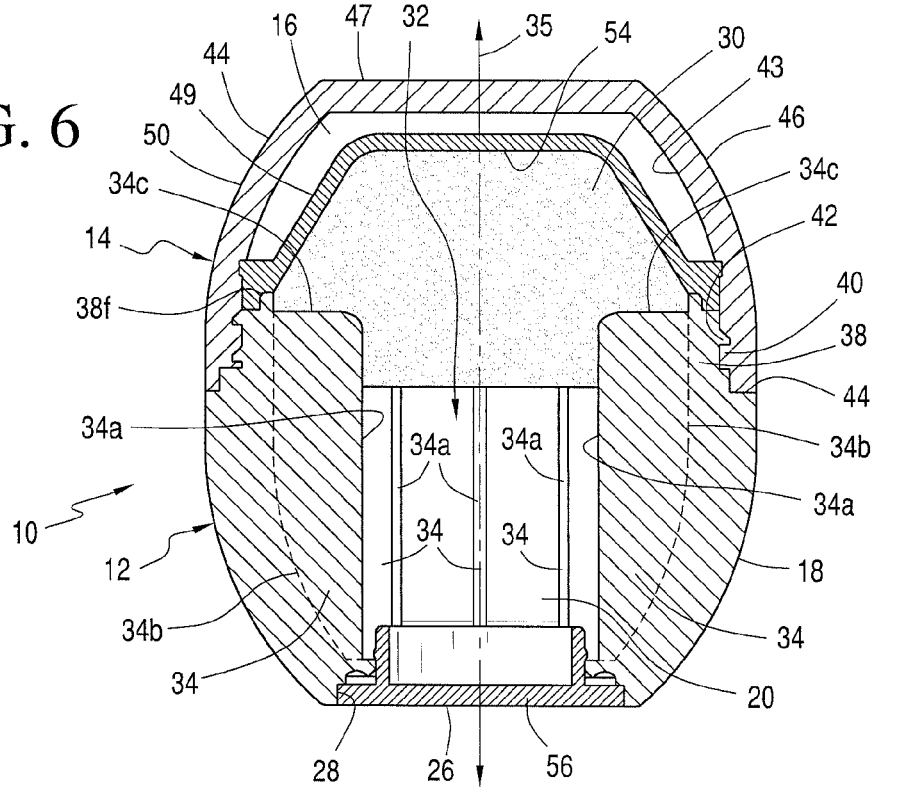
Figure 7:
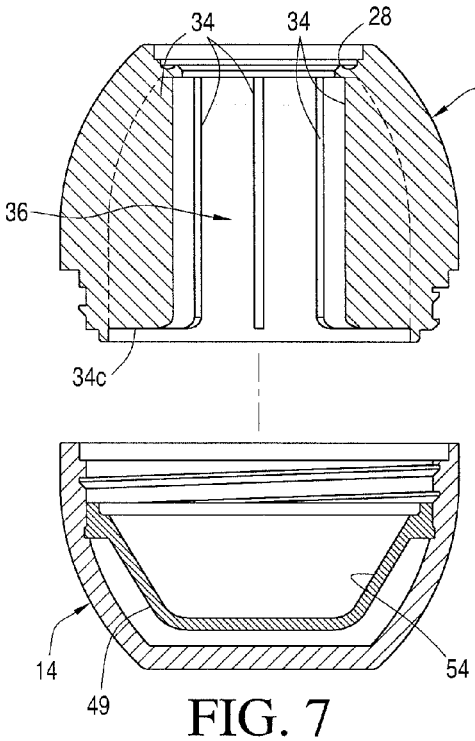
FIGS. 7 through 10 are cross-sectional views showing the process of filling and assembling the present container.
Figure 9:
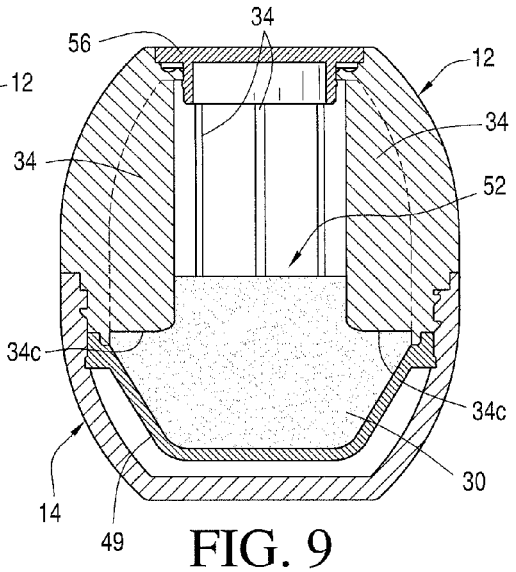
Figure 8:
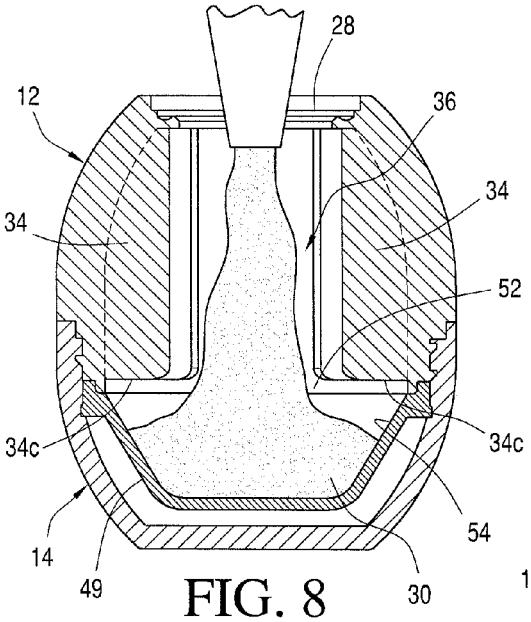
Figure 10:
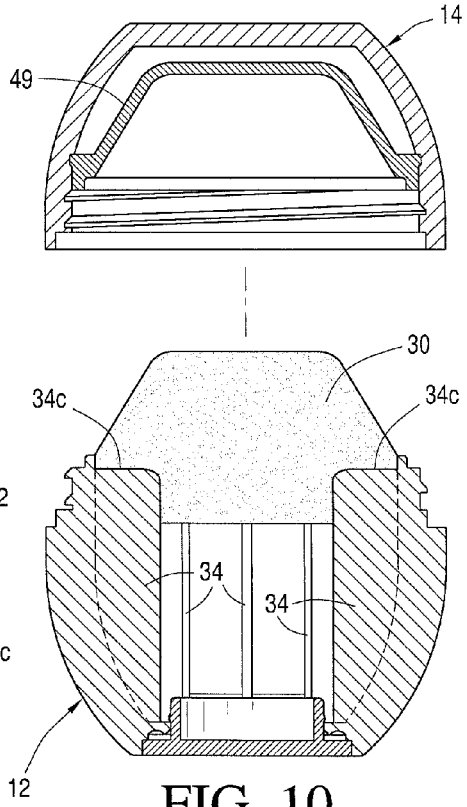

In practice, the parts of the present container 10 are first molded. Thereafter, the second container member 14, with the molding cup 49 positioned therein, is screwed down onto the first container member 12. With the first and second container members 12, 14 secured together a container cavity 52 for receipt of cosmetic product 30 is defined. On an assembly line the liquefied cosmetic product 30 is poured through the aperture 28, and through the elongated passageway 36, in the first container member 12, with the second container member 14 facing downwardly so that gravity forces the balm into the frustoconical molding cavity 54 defined by the interior surface of the molding cup 49. The container cavity 52 defined by both the first and second container members 12, 14 is filled until the molding cavity 54 is filled with a measured amount of the cosmetic product 30 such that the cosmetic product 30 contacts and covers the supporting edges 34*c* and extends down a portion of the ribs 34, as shown in FIG. 6. The filled container 10 continues to travel down the assembly line and is sealed with the plug 56 inserted into the aperture 28 before the container 10 drops off of the assembly line into a collection bin.

The liquefied cosmetic product 30 is permitted to cool as it travels down the assembly line such that it hardens into to substantially solid balm contained within the frustoconical molding cavity 54. Once the cosmetic product 30 has solidified, the container 10 may be inverted with the first container member 12 sitting beneath the second container member 14. In this orientation, the supporting edges 34*c* of the ribs 34 of the first container member 12 will support the cosmetic product 30 as the second container member 14 is unscrewed providing a user with access to the cosmetic product 30.

As shown with reference to FIGS. 12 to 15 and FIGS. 16 to 19, it is possible to form the ribs of the first container member in various ways within the spirit of the present invention. First, and with reference to FIGS. 11 to 14, the ribs 134 may be constructed such that the supporting edge 134*c* of each of the ribs 134 does not extend the entire way to circumferential free edge 124 of the first container member 112. Despite this variation, the free edges 134*a* of the ribs 134 remain the same and, when considered in conjunction with the aperture 128, define the elongated passageway extending on the central axis of the semi-spherical body defined by the first container member 112.

More particularly, each of the ribs 134 radially extends from the interior surface 120 toward the central axis of the first cavity 132 (that is, the axis normal to the apex 126 of the first container member 112). Each of the ribs 134 includes the free edge 134*a*, an attached edge 134*b*, and a supporting edge 134*c*. Because of the spacing between the supporting edges 134*c* and the circumferential free edge 124, the plurality of ribs 134 each include a slot 137 which define an annular ring between the supporting edges 134*c* and the circumferential free edge 124.

Figure 14:
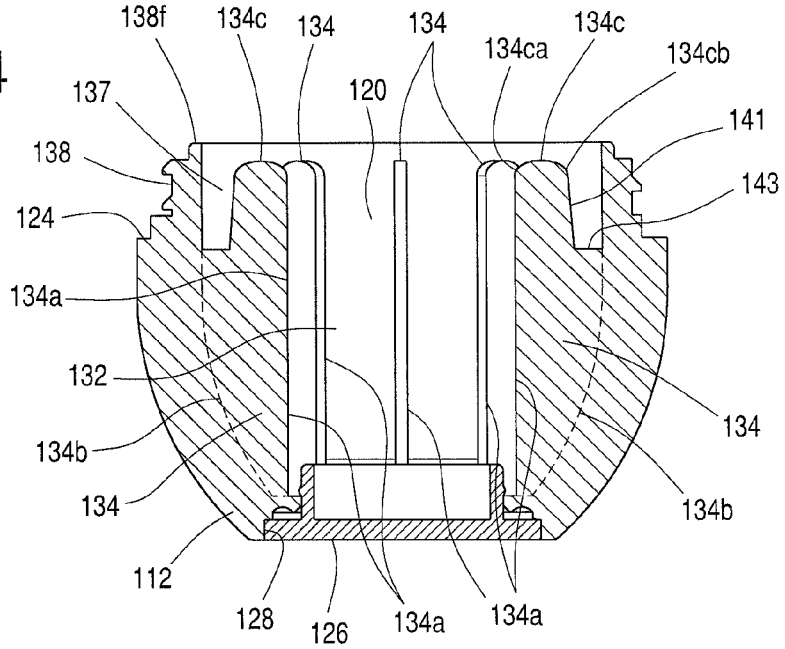
FIG. 14 is a cross-sectional view of the first container member in accordance with the embodiment shown in FIG. 12.
Figure 15:
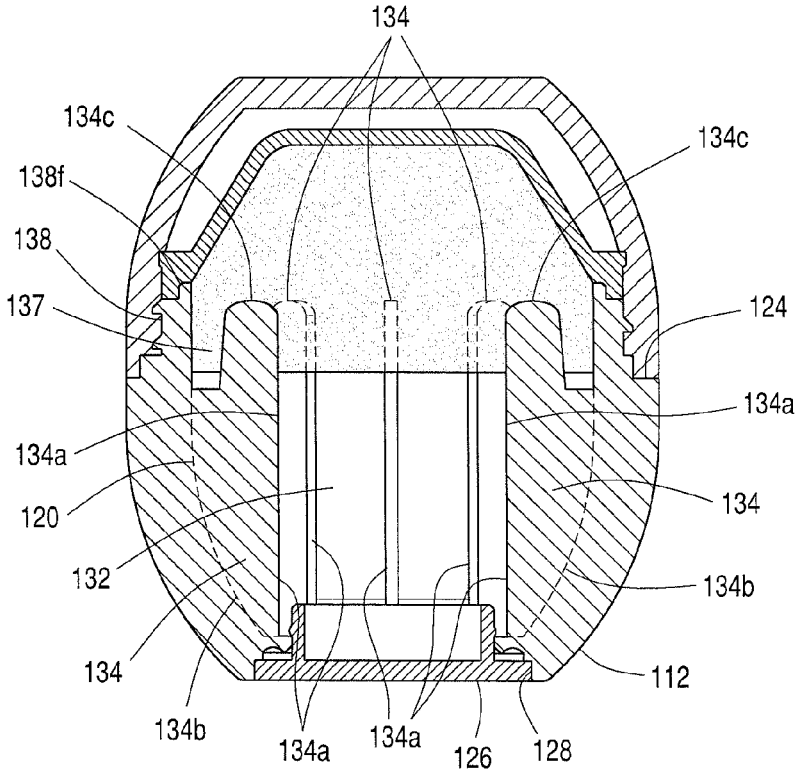
FIG. 15 is a cross-sectional view showing the container filled with cosmetic product in accordance with the embodiment shown in FIG. 12.

As a result of the slot 137, and with reference to FIG. 14, the supporting edge 134*c* of each of the ribs 134 includes an interior end 134*ca* adjacent the cylindrical passageway and an exterior end 134*cb* adjacent to, but spaced from, the circumferential free edge 124 of the first container member 112. The supporting edge 134*c* is, therefore, connected to the attached edge 134*b* by first and second edge members 141, 143 extending between the supporting edge 134*c* and the attached edge 134*b*. The first edge member 141 extends directly from the exterior end 134*cb* of the supporting edge 134*c* and is substantially parallel to the central axis 135. The second edge member 143 extends from the first edge member 141 to the attached edge 134*b*, and is substantially perpendicular to the central axis 135.

The ribs 134 are of such a height that they extend along the interior wall 120 to a height slightly below the plane in which the free end 138*f* of the upwardly extending ridge 138 of the circumferential free edge 124 of the first container member 112 lies. Consequentially, the supporting edges 134*c* of the ribs 134 lie in a plane slightly below the plane in which the free end 138*f* of the upwardly extending ridge 138 of the circumferential free edge 124 of the first container member 112 lies. By recessing the supporting edges 134*c* slightly below the free end 38*f* of the upwardly extending ridge 138, a retaining edge is defined that assists in maintaining the cosmetic product in position upon the ribs 134.

Each of the ribs 134 extend radially inwardly from the interior surface 120 toward the central axis and end before they reach the central axis of the first cavity 132. The free edge 134*a* is, therefore, radially spaced from the central axis and positioned in alignment with the cylindrical passageway. As such, the free edges 134*a* of the ribs 134, in conjunction with the aperture 128, define the cylindrical passageway.

Further, and with reference to FIGS. 15 to 18, the ribs 234 may be constructed such that the supporting edge 234*c* of each of the ribs 234 does not extend the entire way to circumferential free edge 224 of the first container member 212 and the free edge 234*a* of each of the ribs 234 does not extend the entire way from the supporting edge 234*c* to the interior surface 220 of the first container member 212.

More particularly, each of the ribs 234 radially extends from the interior surface 220 toward the central axis 235 of the first cavity 232 (that is, the axis normal to the apex 226 of the first container member 212). Each of the ribs 234 includes the free edge 234*a*, the attached edge 234*b*, and the supporting edge 234*c*. Because of the spacing between the supporting edges 234*c* and the circumferential free edge 224, the plurality of ribs 234 each include a slot 237 which define an annular ring formed between the supporting edges 234*c* and the circumferential free edge 224. As a result of the first slot 237, and as with the embodiment disclosed with reference to the embodiment of FIGS. 11 to 14, the supporting edge 234*c* of each of the ribs 234 includes an interior end 234*ca* adjacent the cylindrical passageway 236 and an exterior end 234*cb* adjacent to, but spaced from, the circumferential free edge 224 of the first container member 212. The supporting edge 234*c* is, therefore, connected to the attached edge 234*b* by first and second edge members 241, 243 extending between the supporting edge 234*c* and the attached edge 234*b*. The first edge 241 extends directly from the exterior end 234*ca* of the supporting edge 234*c* and is substantially parallel to the central axis 235. The second edge member 243 extends from the first edge member 241 to the attached edge 234*b*, and is substantially perpendicular to the central axis 235.

The ribs 234 are of such a height that they extend along the interior wall 220 to a height slightly below the plane in which the free end 238*f* of the upwardly extending ridge 238 of the circumferential free edge 224 of the first container member 212 lies. Consequentially, the supporting edges 234*c* of the ribs 234 lie in a plane slightly below the plane in which the free end 238*f* of the upwardly extending ridge 238 of the circumferential free edge 224 of the first container member 212 lies. By recessing the supporting edges 234*c* slightly below the free end 238*f* of the upwardly extending ridge 238, a retaining edge is defined that assists in maintaining the cosmetic product in position upon the ribs 234.

Each of the ribs 234 extend radially inwardly from the interior surface 220 toward the central axis and end before they reach the central axis of the first cavity 232. The free edge 234*a* is, therefore, radially spaced from the central axis and positioned in alignment with the cylindrical passageway. As such, the free edges 234*a* of the ribs 234, in conjunction with the aperture 228, define the cylindrical passageway.

Figure 16:
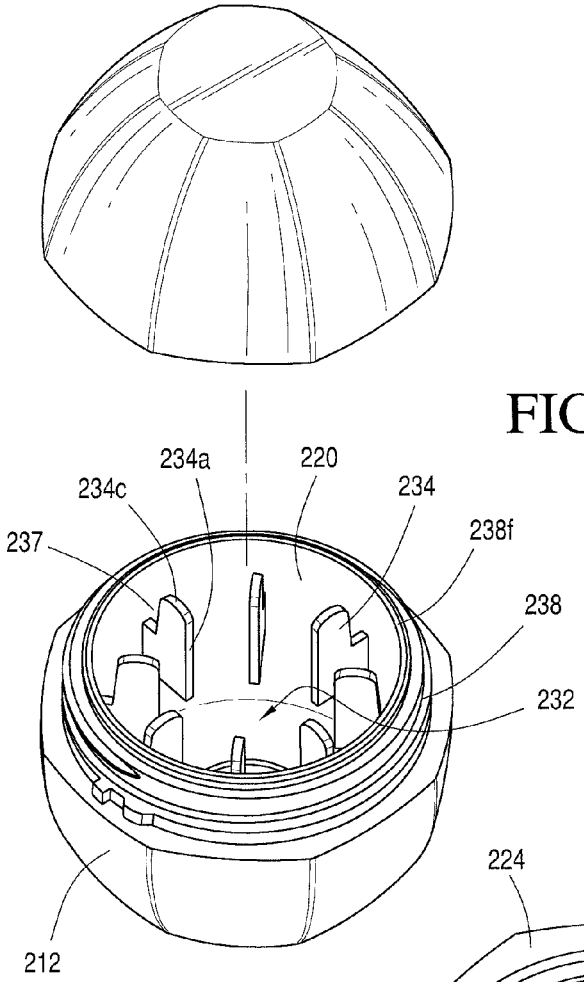
FIG. 16 is a perspective view of the open container in accordance with an alternate embodiment of the present invention.
Figure 17:
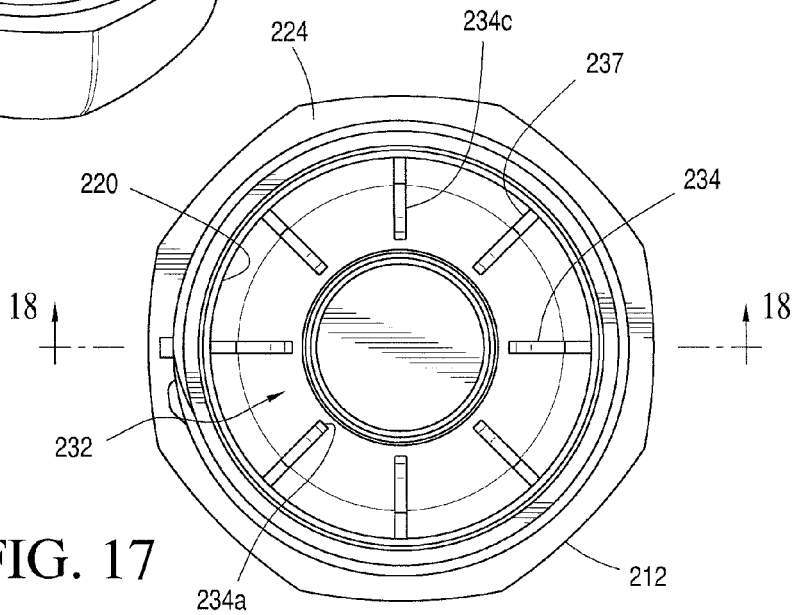
FIG. 17 is a top plan view of the first container member in accordance with the embodiment shown in FIG. 16.
Figure 18:
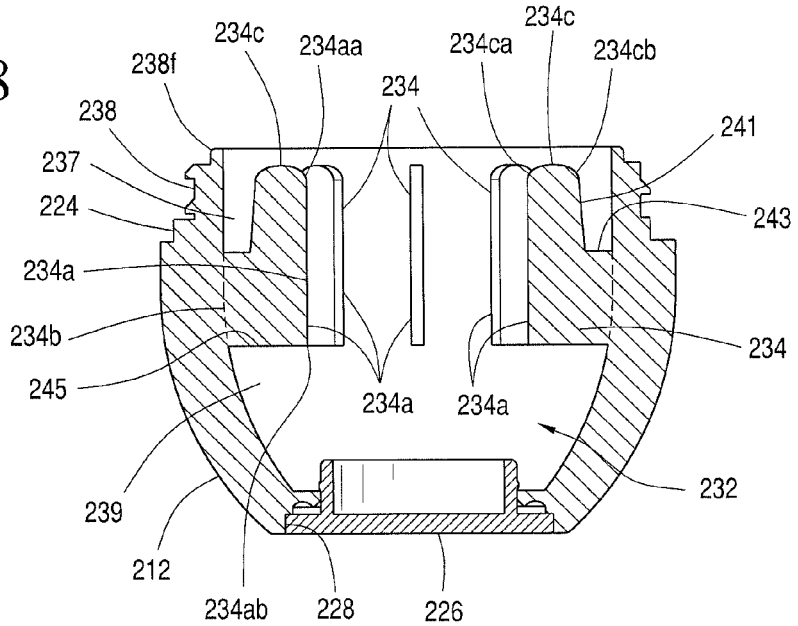
FIG. 18 is a cross-sectional view of the first container member in accordance with the embodiment shown in FIG. 16.
Figure 19:
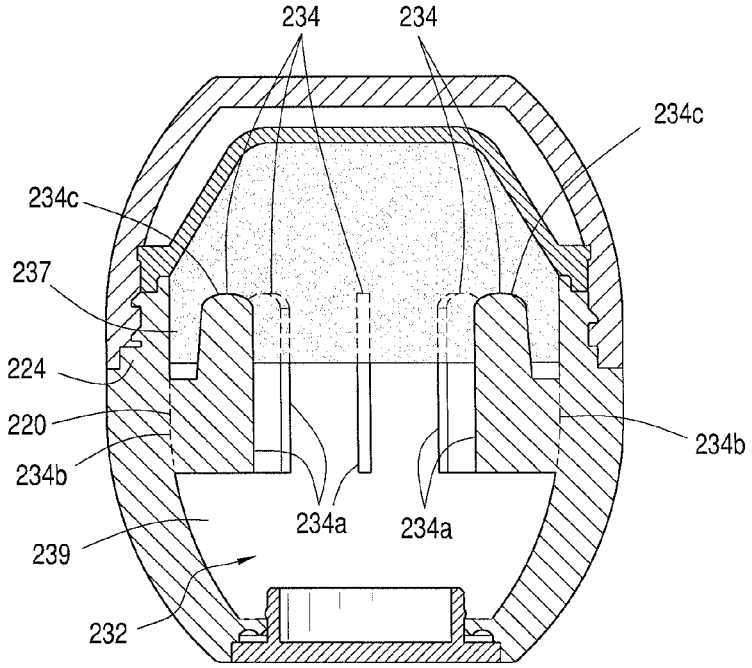
FIG. 19 is a cross-sectional view showing the container filled with cosmetic product in accordance with the embodiment shown in FIG. 16.

In contrast to other embodiments, and with reference to FIGS. 16-18, the length of the free edges 234*a* is shortened. The free edge 234*a* of each of the ribs 234 includes an upper end 234*aa* adjacent the supporting edge 234*c* and an exterior end 234*ab* adjacent to, but spaced from, the interior surface 220 of the first container member 212 adjacent to the aperture 228. The free edge 234*a* is, therefore, connected to the attached edge 234*b* by a first edge members 245 extending between the free edge 234*a* and the attached edge 234*b*. The first edge member 245 extends directly from the exterior end 234*ab* of the free edge 234*a* to the attached edge 234*b* and is substantially perpendicular to the central axis and is spaced by gap 239 from the bottom of the first container member 212.

While the preferred embodiments have been shown and described, it will be understood that there is no intent to limit the invention by such disclosure, but rather, it is intended to cover all modifications and alternate constructions falling within the spirit and scope of the invention.

We claim:

1. A container for dispensing a cosmetic product, comprising:

a first container member and a second container member shaped and dimensioned for coupling together so as to define a cavity therebetween for storing a cosmetic product;

the first container member includes an exterior surface and an interior surface, the first container member further includes an apex having an aperture formed therein and an open end opposite the apex, the open end including a circumferential free edge that is opposite the aperture wherein the interior surface extends between the aperture and the open end;

a plurality of ribs radially extending inwardly from the interior surface of the first container member toward a central axis running through a center of the aperture such that the plurality of ribs define an elongated passageway extending on the central axis, and each of the plurality of ribs consisting of an edge attached to the interior surface, a free edge and a supporting edge shaped and dimensioned for supporting cosmetic product above the supporting edge after cosmetic product is gravity fed through the passageway to partially fill the first container member whereby the cosmetic product is solely supported by the plurality of ribs; and a plug covering the aperture after the cosmetic product has been fed into the cavity.

2. The container of claim 1, further including a cosmetic product stored within the cavity.

3. The container of claim 1, wherein the second container member includes a closed end and an open end opposite the closed end, wherein the open end defines a circumferential free edge.

4. The container of claim 3, wherein the circumferential free edge of the second container member includes threads which mate with threads on the circumferential free edge of the first container member.

5. The container of claim 3, wherein the second container member includes a molding cup frictionally retained between the closed end and the open end thereof.

6. The container of claim 1, wherein the supporting edge is flat.

7. The container of claim 1, wherein the supporting edge has a curved profile.

8. A container for dispensing a cosmetic product, comprising:

a first container member and a second container member shaped and dimensioned for coupling together so as to define a cavity therebetween for storing a cosmetic product;

the first container member includes an exterior surface and an interior surface, the first container member further includes an apex having an aperture formed therein and an open end opposite the apex, the open end including a circumferential free edge that is opposite the aperture wherein the interior surface extends between the aperture and the open end;

a plurality of ribs radially extending inwardly from the interior surface of the first container member toward a central axis running through a center of the aperture such that the plurality of ribs define an elongated passageway extending on the central axis, and each of the plurality of ribs includes an edge attached to the interior surface, a free edge and a supporting edge shaped and dimensioned for supporting cosmetic product above the supporting edge after cosmetic product is gravity fed through the passageway; wherein each of the plurality of ribs includes a slot which defines an annular ring between the supporting edges of the plurality of ribs and the interior surface; and a plug covering the aperture after the cosmetic product has been fed into the cavity.

9. A container for dispensing a cosmetic product, comprising:

a first container member and a second container member shaped and dimensioned for coupling together so as to define a cavity in which a cosmetic product is stored;

the first container member includes an exterior surface and an interior surface, the first container member further includes an apex having an aperture formed therein and an open end opposite the apex, the open end including a circumferential free edge that is opposite the aperture wherein the interior surface extends between the aperture and the open end;

a plurality of ribs integrally formed with the first container member, the plurality of ribs radially extending inwardly from the interior surface of the first container member toward a central axis running through a center of the aperture such that the plurality of ribs define an elongated passageway extending on the central axis, and each of the plurality of ribs includes an edge attached to the interior surface, a free edge and a supporting edge shaped and dimensioned for supporting the cosmetic product above the supporting edge after the cosmetic product is gravity fed through the passageway to partially fill the first container member whereby the cosmetic product is solely supported upon the free edge and the supporting edge of the plurality of ribs; and a plug covering the aperture after the cosmetic product has been fed into the cavity.

10. The container of claim 9, wherein the second container member includes a closed end and an open end opposite the closed end, wherein the open end defines a circumferential free edge.

11. The container of claim 10, wherein the circumferential free edge of the second container member includes threads which mate with threads on the circumferential free edge of the first container member.

12. The container of claim 10, wherein the second container member includes a molding cup frictionally retained between the closed end and the open end thereof.

13. The container of claim 9, wherein the supporting edge is flat.

14. The container of claim 9, wherein the supporting edge has a curved profile.

* * * * *